US005462028A

United States Patent [19]

Buckley

[11] Patent Number: 5,462,028

[45] Date of Patent: Oct. 31, 1995

[54] FUEL PUMPING APPARATUS

[75] Inventor: Paul Buckley, Rainham, England

[73] Assignee: Lucas Industries public limited company, Solihull, England

[21] Appl. No.: 301,174

[22] Filed: Sep. 6, 1994

[30] Foreign Application Priority Data

Sep. 17, 1993 [GB] United Kingdom ..... 9319283

[51] Int. Cl.[6] ..... F02M 37/04

[52] U.S. Cl. ..... 123/447; 123/508

[58] Field of Search ..... 123/508, 509, 123/507, 447, 446, 450

[56] References Cited

U.S. PATENT DOCUMENTS

| | | | |
|---|---|---|---|
| 929,101 | 7/1909 | McCarty | 123/447 |
| 943,987 | 12/1909 | McCarty | 123/447 |
| 1,585,277 | 5/1926 | Bell | 123/447 |
| 4,567,872 | 2/1986 | Roosa | 123/508 |
| 4,649,887 | 3/1987 | Igashira | 123/508 |
| 4,768,475 | 9/1988 | Ikemura | 123/90.17 |
| 4,879,984 | 11/1989 | Rembold | 123/450 |

FOREIGN PATENT DOCUMENTS

| | | | |
|---|---|---|---|
| 0560126A1 | 2/1993 | European Pat. Off. . | |
| 270938 | 12/1950 | Switzerland | 123/508 |
| 170251 | 10/1921 | United Kingdom | 123/508 |
| 2099078 | 12/1982 | United Kingdom . | |
| 88-02068 | 3/1988 | WIPO . | |

*Primary Examiner*—Carl S. Miller
*Attorney, Agent, or Firm*—Trexler, Bushnell, Giangiorgi & Blackstone

[57] ABSTRACT

A fuel pumping apparatus for supplying fuel to an engine includes a pumping plunger housed in a bore one end of which connects with an outlet and also by way of a valve with a source of fuel under pressure. Also provided is a further plunger housed in a further bore one end of which is connected to an accumulator volume. Cam means is provided to urge the further plunger towards the one end of its bore to compress the fluid in the accumulator and the outward movement of the further plunger under the action of the compressed fluid is transmitted to the pumping plunger to displace fuel through the outlet.

9 Claims, 1 Drawing Sheet

FUEL PUMPING APPARATUS

This invention relates to a fuel pumping apparatus for supplying fuel to an internal combustion engine, the apparatus comprising a pumping plunger movable in a bore, a valve controlled fuel inlet to the bore, an outlet from the bore, the outlet in use being connected to an injection nozzle of the associated engine and means for actuating the pumping plunger.

The object of the invention is to provide an apparatus of the aforesaid type in a simple and convenient form.

According to the invention in a pumping apparatus of the kind specified the means for actuating the pumping plunger comprises a further plunger housed in a further bore, an accumulator volume connected to the inner end of the further bore, means operable to move the further plunger towards said one end of the further bore thereby to repressurise fluid contained in the accumulator volume and means coupling the plungers whereby when the further plunger is allowed to move away from said one end of the further bore, the pumping plunger will be moved inwardly towards said one end of the first mentioned bore to displace fuel through the outlet.

An example of an apparatus in accordance with the invention will now be described with reference to the accompanying drawings in which.

Figure 2:
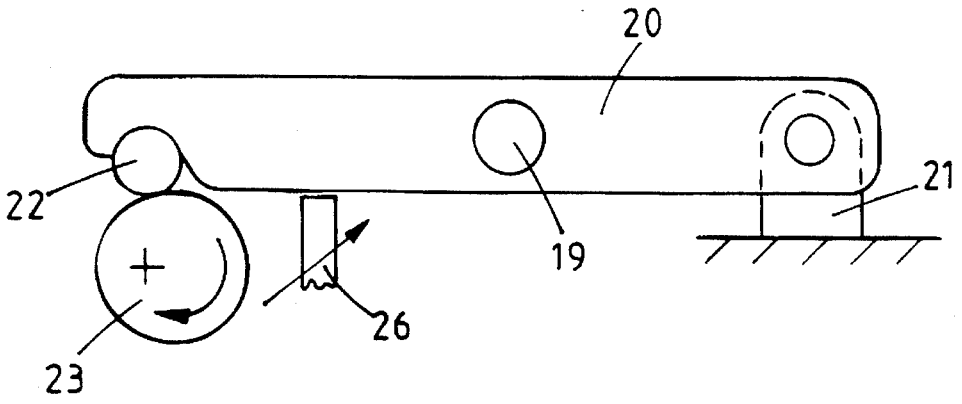
FIG. 2 is a drawing similar to FIG. 1 showing an actuating mechanism for the apparatus shown in FIG. 1.
Figure 1:
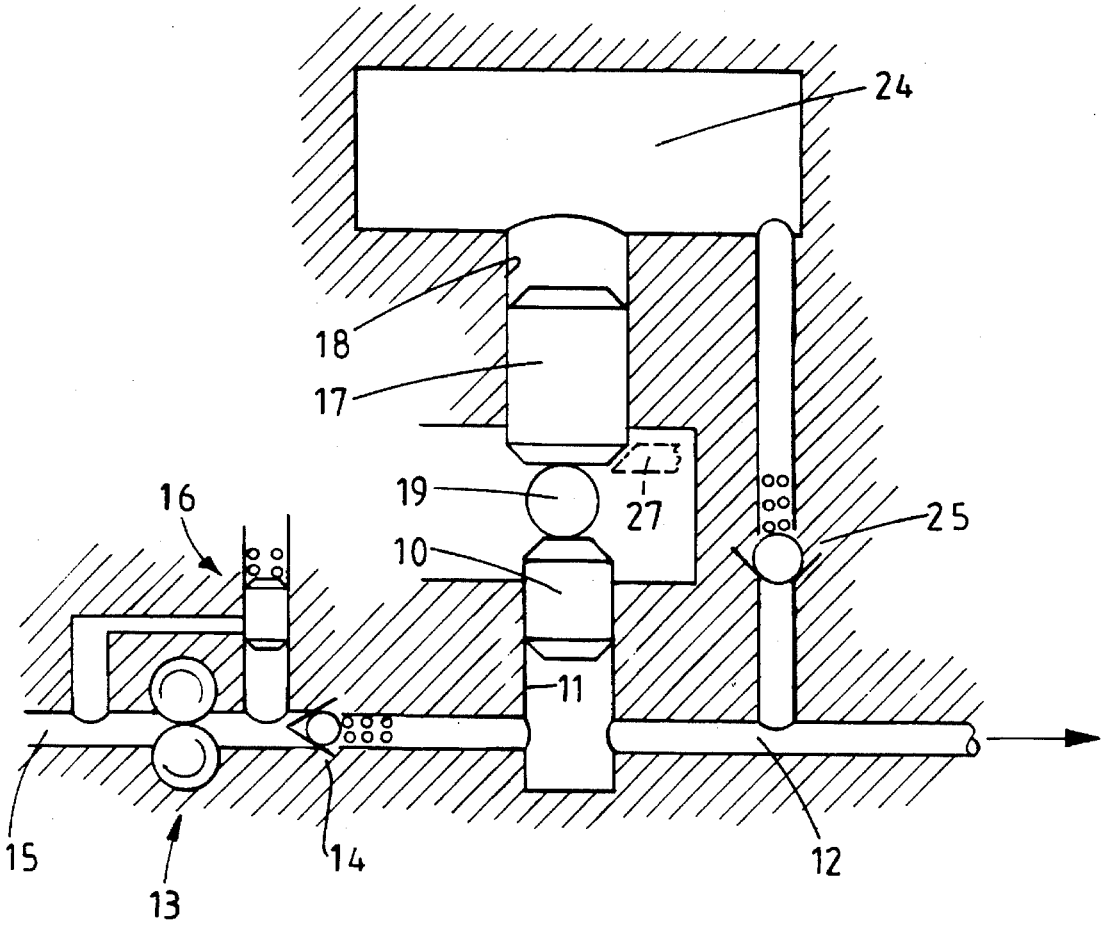
FIG. 1 is a diagrammatic drawing of the apparatus.

Referring to the drawings the apparatus comprises a pumping plunger 10 which is mounted in a bore 11 extending from which is an outlet passage 12 which in use is connected to a fuel injection nozzle of the associated engine or may be connected in turn to the injection nozzles by means of a rotary distributor member not shown.

The apparatus also includes a low pressure fuel supply pump 13 having an outlet which is connected to the bore 11 through a non-return valve 14. The pump 13 is provided with an inlet 15 which is connected to a source of fuel and the inlet and outlet of the pump 13 are interconnected by way of a relief valve 16.

The apparatus also includes a further plunger 17 which is slidable within a bore 18 co-axial with the bore 11, the bore 18 and the plunger 17 having a slightly larger diameter than the bore 11. The presented outer ends of the plungers have interposed between them a pin 19 which as will be seen from FIG. 2, is mounted intermediate the ends of a lever 20 one end of which is pivotally mounted on a fixed support 21 and the other end of which carries a roller 22 for engagement with the peripheral surface of a rotary cam 23.

The bore 18 communicates with an accumulator volume 24 and this is connected to the outlet 12 by way of a non-return valve 25.

In operation, and starting from the position of the parts as shown in the drawings, the roller 22 is moving down the trailing portion of the cam and the lever 20 is moving in the anti-clockwise direction under the influence of the fuel pressure in the accumulator volume 24 acting on the plunger 17. The plunger 10 is therefore displacing fuel from the bore 11 and the displaced fuel is being supplied to the associated engine. When the roller 22 moves onto the leading portion of the cam the piston 17 is moved upwardly thereby repressurising the fuel in the accumulator volume 24. Moreover, the plunger 10 is allowed to move outwardly of the bore 11 and the fuel pressure in the outlet passage 12 is reduced thereby allowing the valve in the fuel injection nozzle to close. The further outward movement of the plunger 10 takes place under the action of fuel under pressure from the low pressure pump 13 so that contact is maintained between the plunger 10 and the pin 19. Pressurisation of the accumulator volume 24 and filling of the bore 11 continue to take place until the roller 22 again starts to move onto the trailing portion of the cam whereupon the process as described is repeated. If the outlet passage 12 is connected to a rotary distributor member, the next injection nozzle receives fuel so that fuel can be supplied to the engine cylinders in turn.

The pressure at which fuel is delivered through the outlet passage 12 is higher than the pressure in the accumulator volume 24 and the purpose of the valve 25 is to allow fuel from the outlet passage 12 to flow into the accumulator volume to make up any fuel which may have been lost through leakage along the working clearance between the plunger 17 and the bore 18. In the example, the plunger 17 has an area 1.2 times that of the plunger 10 and the nominal pressure of fuel in the accumulator volume is 1,000 bar. The pressure of fuel in the outlet passage is approximately 1,200 bar and the valve 25 is set to open at a pressure difference of 200 bar. The opening pressure of the valve 25 may be adjustable to allow the pressure in the accumulator volume to be varied.

In order to control the quantity of fuel supplied to the associated engine, an adjustable stop 26 may be provided to limit the movement of the lever 20 as the roller is moving along the trailing portion of the cam. The same effect can be obtained by providing an adjustable stop shown in dotted outline at 27, to limit the movement of the plunger 17 under the action of the fuel pressure in the accumulator volume 24, such limitation of the movement of the plunger 17 also limiting the movement of the pumping plunger.

In an alternative construction the cam 23 acts directly on the face of the plunger 17 instead of the pin 19 which along with the lever 20 is not required. The two plungers are interconnected by a rod or the like of a fixed length adequate to ensure that the cam does not engage the plunger 10. As previously mentioned an adjustable stop can be provided to limit the movement of the plunger 17 and hence the plunger 10 in order to control the quantity of fuel supplied.

I claim:

1. A fuel pumping apparatus for supplying fuel to an internal combustion engine comprising a pumping plunger movable in a bore, an outlet from one end of the bore, a valve through which fuel can flow into said one end of the bore and actuating means for moving the pumping plunger towards said one end of the bore to displace fuel through the outlet, said actuating means comprising a further plunger housed in a further bore, an accumulator volume connected to the inner end of the further bore, means operable to move the further plunger towards said inner end of the further bore thereby to pressurise fluid contained in the accumulator volume and means coupling the plungers whereby when the further plunger is allowed to move away from said inner end of the further bore under the action of fuel under pressure in the inner end of the further bore the pumping plunger will be moved inwardly toward said one end of the first mentioned bore to displace fuel through the outlet.

2. A fuel pumping apparatus according to claim 1, in which said further plunger is larger in area than the pumping plunger and a non-return valve interconnects the outlet with the accumulator volume, said non-return valve being constructed so as to allow fuel to flow into said accumulator volume from the outlet.

3. A fuel pumping apparatus according to claim 2, in which the means operable to move the further plunger comprises a cam which is driven in synchronism with the associated engine.

4. A fuel pumping apparatus according to claim 3, in which the ends of the plungers remote from said ends of the respective bores are presented to each other and interposed between the presented ends is a pin through which the movement of the further plunger is transmitted to the pumping plunger, said pin being operable by said cam to move the further plunger towards said one end of the further bore.

5. A fuel pumping apparatus according to claim 4, in which said pin is mounted intermediate the ends of a lever which is pivoted at one end and at its other end carries a roller engageable with the cam.

6. A fuel pumping apparatus according to claim 2, in which said valve is located in a passage which connects said one end of the first mentioned bore with a low pressure fuel supply pump.

7. A fuel pumping apparatus according to claim 5, including an adjustable stop operable to limit the movement of the further plunger away from said one end of the further cylinder.

8. A fuel pumping apparatus according to claim 3, in which the ends of the plungers remote from said ends of the respective bores are presented to each other and said cam is interposed between the presented ends of the plungers but acts on said further plunger only, and a rod interconnecting the presented ends of the plungers, said rod transmitting the movement of the further plunger away from said end of its bore to the pumping plunger.

9. A fuel pumping apparatus for supplying fuel to an internal combustion engine comprising a pumping plunger movable in a bore, an outlet from one end of the bore, a valve through which fuel can flow into said one end of the bore and actuating means for moving the pumping plunger towards said one end of the bore to displace fuel through the outlet, said actuating means comprising a further plunger housed in a further bore, an accumulator volume connected to the inner end of the further bore, means operable to move the further plunger towards said inner end of the further bore thereby to pressurise fluid contained in the accumulator volume and means coupling the plungers whereby when the further plunger is allowed to move away from said inner end of the further bore the pumping plunger will be moved inwardly toward said one end of the first mentioned bore to displace fuel through the outlet, said further plunger being larger in area than the pumping plunger and a non return valve interconnects the outlet with the accumulator volume, said non-return valve being constructed so as to allow fuel into said accumulator volume from the outlet.

* * * * *